US006173582B1

(12) United States Patent
Hixson

(10) Patent No.: US 6,173,582 B1
(45) Date of Patent: Jan. 16, 2001

(54) SELF-DISPENSING PORTABLE COOLER

(75) Inventor: Dennis Michael Hixson, Bristol, TN (US)

(73) Assignee: Sta-Kul, L.L.C., Kingsport, TN (US)

( * ) Notice: Under 35 U.S.C. 154(b), the term of this patent shall be extended for 0 days.

(21) Appl. No.: 09/293,222

(22) Filed: Apr. 16, 1999

(51) Int. Cl.[7] ..... F25D 3/08
(52) U.S. Cl. ..... 62/457.4; 62/3.64
(58) Field of Search ..... 62/3.2, 3.62, 3.64, 62/530, 457.4, 378

(56) References Cited

U.S. PATENT DOCUMENTS

| | | | | |
|---|---|---|---|---|
| 1,023,116 | | 4/1912 | Bailey . | |
| 1,240,321 | | 9/1917 | Dickinson . | |
| 2,852,327 | | 9/1958 | Mason . | |
| 4,368,625 | * | 1/1983 | Platt | 62/378 |
| 4,676,074 | * | 6/1987 | Morgan et al. | 62/277 |
| 4,899,904 | | 2/1990 | Dooley et al. . | |
| 5,247,798 | | 9/1993 | Collard, Jr. . | |
| 5,396,997 | | 3/1995 | Johnson . | |
| 5,788,117 | | 8/1998 | Zimmanck . | |
| 5,899,088 | * | 5/1999 | Purdum | 62/371 |
| 6,056,152 | * | 5/2000 | Gonzalez | 221/150 R |

* cited by examiner

*Primary Examiner*—William Doerrler
*Assistant Examiner*—Melvin Jones
(74) *Attorney, Agent, or Firm*—Susan F. Johnston

(57) ABSTRACT

Disclosed herein is a self-dispensing cooler comprising a) a cabinet defined by a plurality of opposing walls and a top and a bottom;

b) a filling means for adding items to said cabinet located near the top of one of said walls;

c) a dispensing means positioned vertically distal from said filling means on one of said walls; and d) a cooling means positioned at least partially inside said cabinet wherein said cooling means defines an inclined channel connecting said filling means to said dispensing means. The self-dispensing cooler is preferably portable.

19 Claims, 4 Drawing Sheets

SELF-DISPENSING PORTABLE COOLER

FIELD OF THE INVENTION

The present invention is directed to the field of portable coolers, particularly self-dispensing coolers used for dispensing food items such as canned soda and beer.

BACKGROUND

Various types of portable coolers have been designed to enable persons to keep food items such as canned beverages handy while traveling and engaging in various outdoor activities where a traditional electric refrigerator is not available. The traditional portable cooler was simply an insulated container. Food may be chilled longer by adding cooling means to an insulated container. Examples of such cooling means include ice, various cold packs containing a chillable or freezable liquid, and various thermoelectric cooling means. Thermoelectric cooling means include devices which require constant electrical input and devices which require only intermittent electrical input. Such thermoelectric coolers are often chilled by relatively portable electric sources such as automobile cigarette lighter outlets and portable batteries and generators.

A large portion of the chilled air inside of a cooler is lost due to the influx of ambient air each time that the lid of a cooler is removed. Much of the rifling through a cooler is done to choose from an assortment of food items. Since it is often desirable to provide an abundance of cool beverages during sporting and leisure events, it would be beneficial to provide a self-dispensing cooler designed especially for dispensing a favorite packaged beverage item with a minimum loss of cooled air upon dispensing. There is a need for a portable-sized cooler designed particularly to maximize the storage capacity and cooling efficiency of food items, particularly beverages packaged in cylindrical containers. Such an improved cooler design should be beneficially used with either thermoelectric or non-thermoelectric cooling means.

SUMMARY OF THE INVENTION

The present invention comprises a self-dispensing cooler including a cabinet defined by a plurality of opposing walls and a top and a bottom; a filling means for adding items to the cabinet located near the top of one of the walls; a dispensing means positioned vertically distal from the filling means on one of said walls; and a cooling means positioned at least partially inside the cabinet, wherein the cooling means defines an inclined channel connecting the filling means to the dispensing means.

It is an object of the present invention to provide a portable, self-dispensing cooler wherein an increased amount of items can be stored, and efficiently cooled to a desirably low temperature. It is a further object of the present invention to provide a self-dispensing cooler wherein essentially each item stored has direct contact with the cooling means. It is an even further object of the present invention to provide a self-dispensing cooler wherein re-chillable cooling means can be easily removed from the cooler for re-chilling in a freezer or re-chilling by thermoelectric means, if needed. It is a still further object of the present invention to provide a self-dispensing cooler that consistently dispenses items without allowing items to become lodged inside the cooler. These, as well as other objects of the invention will become apparent to those skilled in the art from the following detailed description.

DETAILED DESCRIPTION

Figure 1:
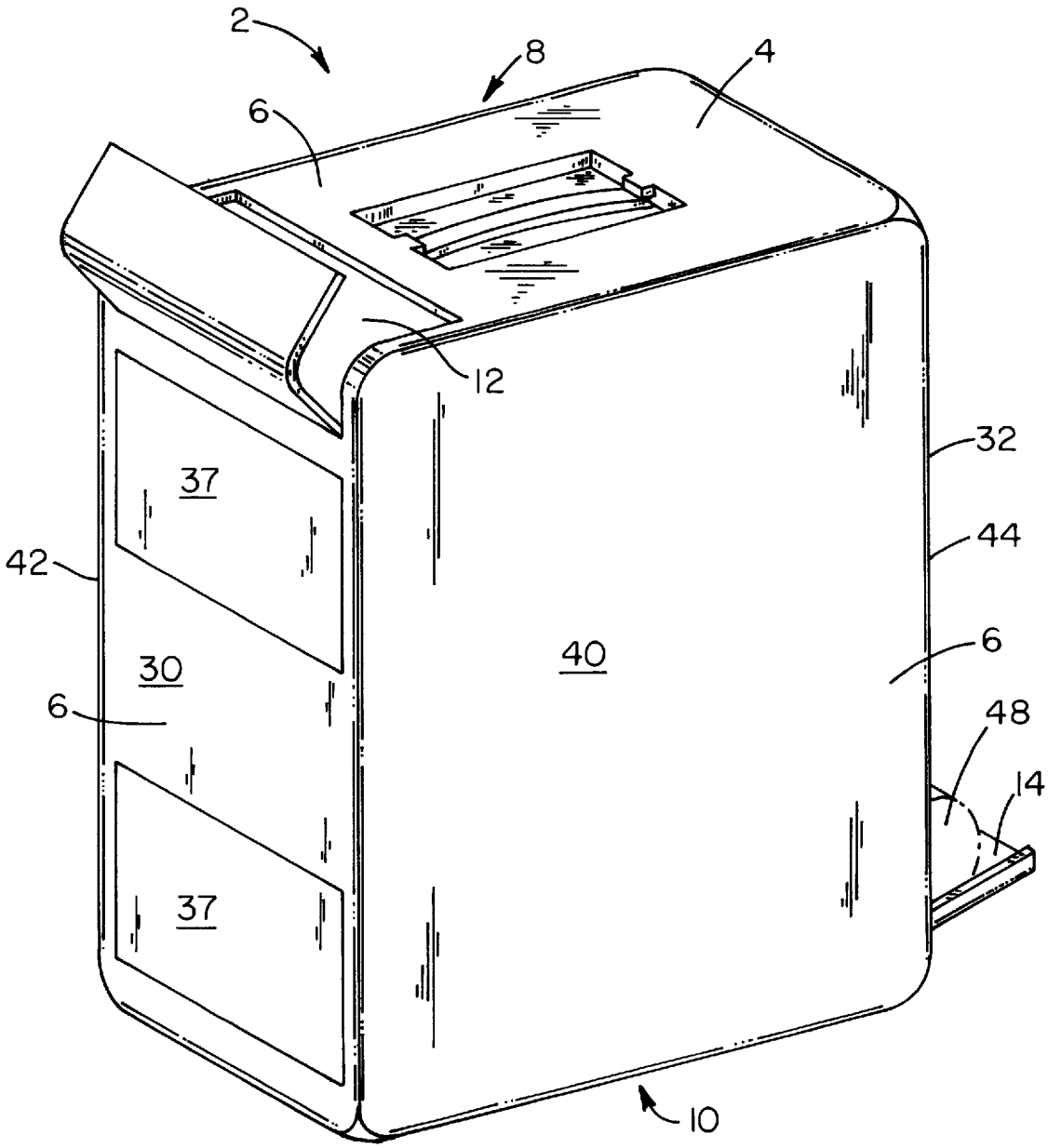
FIG. 1 is an isometric view of the present cooler.
Figure 2:
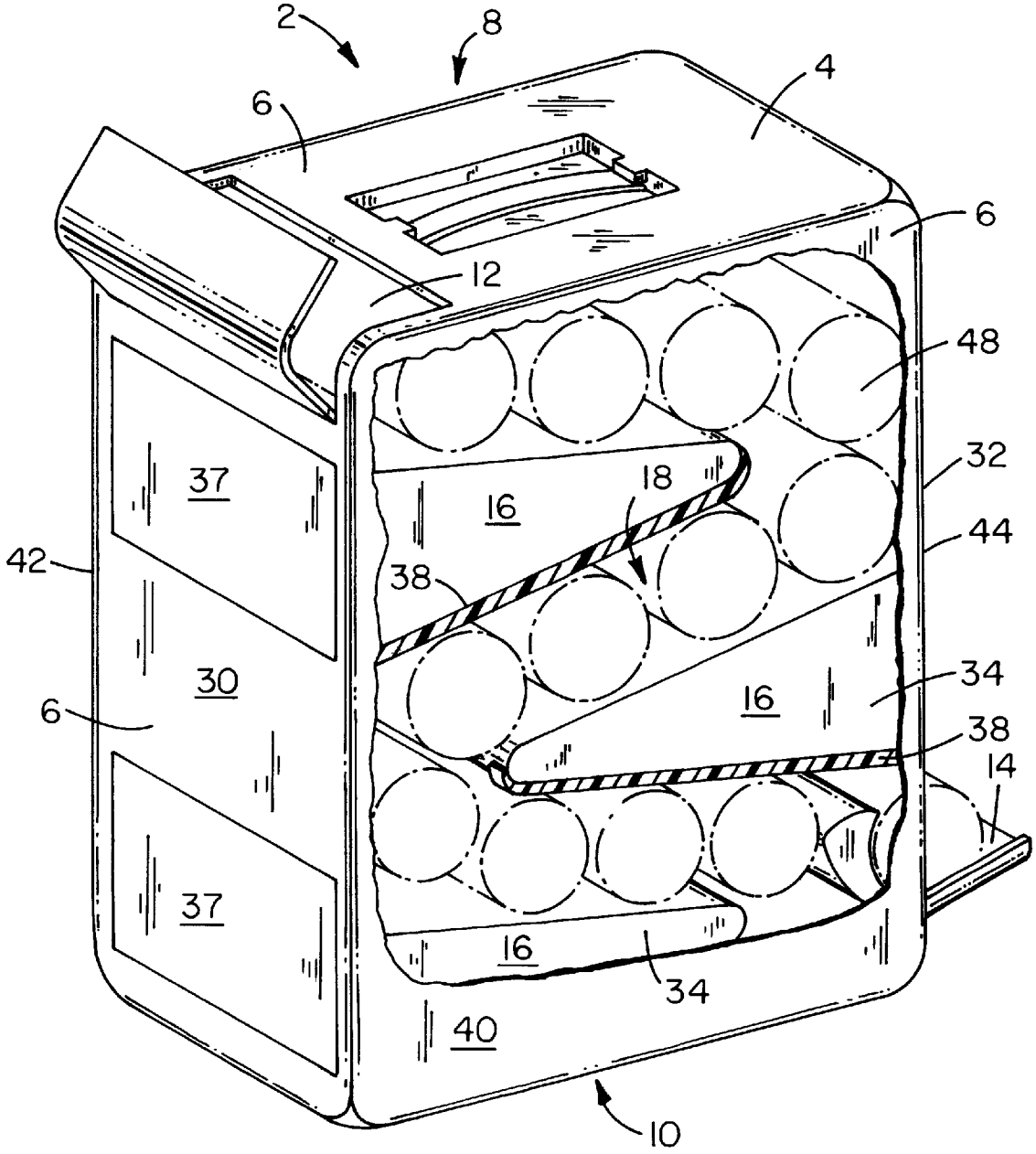
FIG. 2 is an isometric view of a preferred embodiment of the present cooler with the front wall partly broken away.

Referring to FIG. 1 for illustration, the present invention is a self-dispensing portable cooler 2 which comprises a cabinet 4 defined by a plurality of walls 6 and having a top 8 and a bottom 10. A filling means 12 for adding items to the cabinet 4 is located near the top on one of the walls 6. A dispensing means 14 is positioned vertically distal from the filling means 12 on one of the walls 6. As shown in FIG. 2, a cooling means 16 is positioned at least partially inside the cabinet 4, preferably being totally inside the cabinet. The cooling means 16 defines an inclined channel 18 that connects the filling means 12 with the dispensing means 14. The self-dispensing portable cooler of the present invention is surprisingly efficient due to the usage of the cooling means 16 to directly form the inclined channel 18.

The inclined channel 18 will preferably have a sufficient size so that a plurality of items added through the filling means will be forced to align in an essentially singular manner, yet sufficiently large enough to allow for an unobstructed movement of the items downward through the channel. The channel size is preferably defined by a plurality of cooling means advantageously positioned within the cabinet to provide a serpentine shaped channel. FIG. 2 shows a self-dispensing portable cooler wherein four cooling means 16 are arranged against alternatingly opposite walls in the cabinet 4 to provide a serpentine channel having three flights. This preferred alternating positioning of the cooling means defining a serpentine channel, as shown in FIG. 2, provides for an optimum combination of high storage capacity and direct physical contact of the cooling means with essentially all of the items stored in the cabinet. Direct physical contact with the cooling means provides for faster cooling of the stored items to a lower temperature. With the serpentine channel, it is more preferable for the vertical distance between adjacent cooling means to be as small as possible so that the upper portion of each stored item may be closer to a cooling means. This arrangement increases the cooling efficiency and storage capacity, and also provides for a more compact, thus more portable cooler.

The self-dispensing portable cooler of the present invention is preferably small enough and lightweight enough to be portable when filled with stored items. Portability is defined herein as preferably being no more than about 25 pounds. The self-dispensing portable cooler is most useful for storing and dispensing food or beverages packaged in cylindrical containers. Examples of such items include ordinary canned soda and beer products. Since each stored item adds additional weight to the self-dispensing portable cooler, the maximum length of the channel should be limited by a reasonable total weight load of the cooler filled with stored items. Therefore, the preferred unit has an inclined channel having about 2 to about 5 flights, with each flight accommodating about 3 to about 8 items. The cooler of the present invention is particularly useful when designed to hold a typical pre-packaged unit of 6, 12, or 24 beverage containers.

The cooling means of the present self-dispensing portable cooler is a device chillable by either thermoelectric means or by non-thermoelectric means. Cooling means having a thermoelectric cooling panel operated by direct current is well known in the art. Since the present cooler is preferably useful away from a constant power source, it is preferable that the cooling means be intermittently electrically operable to attain a low temperature in the cooling means. Then after the cooling means is removed from the constant power source, the coldness attained in the cooling means is allowed to dissipate from the cooling means into the items stored in the cooler. Such a thermoelectric cooling means is preferably equipped with a transforming and/or rectifying means to permit both conventional alternating household current and/or direct current to be used for supplying power to the thermoelectric cooling panel in the cooling means. Additionally, or alternatively, the power input of the thermoelectric panel is advantageously wired to a plug-type adapter which is insertable in a cigarette lighter of an automobile or other source which would permit energization of the thermoelectric panel by a battery.

The cooling means of the present self-dispensing portable cooler is preferably a non-thermoelectric means such as ice or re-chillable containers filled with chillable or freezable material. Such containers are commonly known as "cold packs" and typically contain a chillable or freezable material such as a liquid or gel. Cold packs are used in the present invention by placement of the cold pack in a freezer long enough to chill or freeze the material inside the cold pack. Then the chilled cold pack is inserted into the cabinet of the present portable cooler when needed. It is preferred that the cooling means used in the present invention is rigid, so that items can move more freely through the channel. A cold pack used in the present invention is preferably constructed as a hard plastic container filled with a freezable material.

Figure 3:
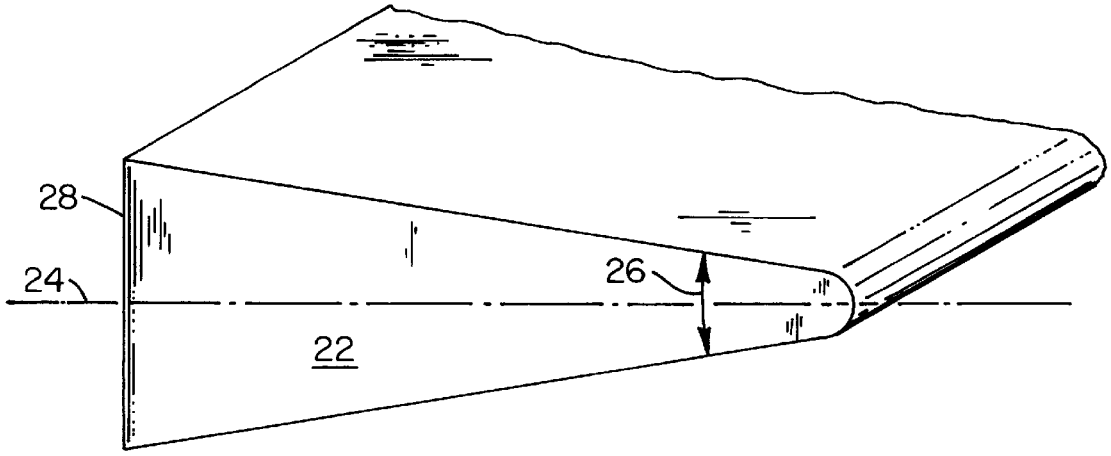
FIG. 3 is an oblique view of the wedge-shaped cooling means of the present invention having an isosceles-triangular cross-section.
Figure 4:
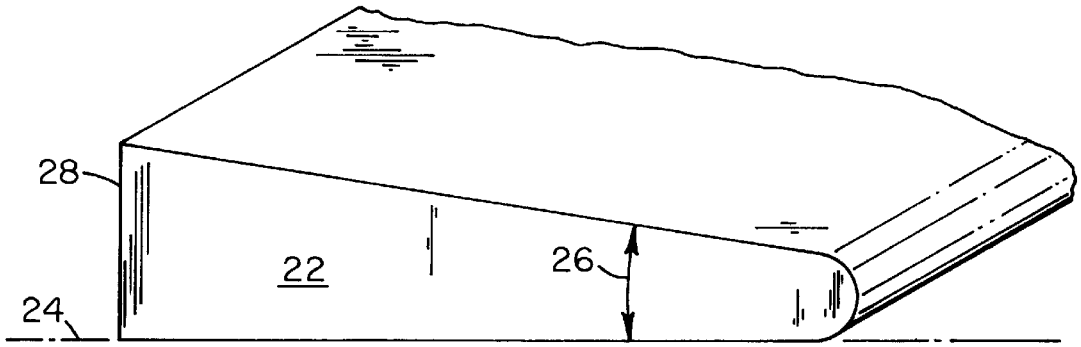
FIG. 4 is an oblique view of the wedge-shaped cooling means of the present invention having a right-triangular cross-section.

The self-dispensing portable cooler of the present invention is especially beneficial when the cooling means 16 has a wedge-shaped outer shell, as shown in FIG. 3 and FIG. 4. The preferred wedge-shaped cooling means has an outer shell 22 having a longitudinal planar axis 24. The shell 22 forms a substantially triangular cross-section about the longitudinal planar axis, with one angle 26 and the base side 28 opposite from that angle lying on the longitudinal planar axis. The cross-section preferably forms an isosceles triangle, with the longitudinal planar axis passing through the center of the base side 28 of the isosceles triangle, as shown in FIG. 3. But the shell forming a right-triangular cross section, as shown in FIG. 4, is also useful in the present cooler. The wedge-shape of the cooling means may be formed by one shell or a combination of two or more shells arranged to provide a wedge shape. However, it is preferable for each wedge-shaped cooling means to be contained inside of a single shell.

Such a wedge-shaped cooling means is particularly useful in the portable cooler of the present invention when it is positioned in the cabinet to define a serpentine channel. As shown in FIG. 2, it is preferable for a plurality of such wedge shaped cooling means to be arranged so that the base sides 28 of the cooling means are alternatingly vertically positioned against opposite side walls 30 and 32, with the longitudinal planar axis 24 of each wedge positioned essentially horizontally inside the cabinet. For reference, "vertical" refers to the direction determining the distance between the filling means and the dispensing means when the filling means and dispensing means are positioned on the same wall, with "horizontal" being perpendicular to vertical. Essentially horizontal placement of the longitudinal planar axis of the wedge-shaped cooling means is a positionment sufficient to provide a downward sloping channel. Horizontal placement is preferred. The shape of the inclined channel defined by such an arrangement of wedge-shaped cooling means is very beneficial for storage and cooling of items. As shown in FIG. 2, cooling means having essentially isosceles-triangular shaped wedge 34, and cooling means having an essentially right-triangular wedge 36, may both be strategically arranged to provide flights of stored items having direct or nearly direct contact with a cooling means from above and below. This provides very effective chilling of the stored items.

A wedge-shaped cooling means is included as part of the present invention. The preferred wedge-shaped cooling means is a rigid wedge-shaped shell filled with a chillable material. Such a cooling means is commonly known as an "cold pack". The chillable material used in cold packs is typically a gel comprising silica and water. The wedge-shape cooling means of the present invention is described above and forms a triangle about it's longitudinal planar axis. The preferred wedge-shaped cooling means forms an isosceles triangular cross-section or a right-triangular cross-section about the axis, as shown in FIG. 3 and FIG. 4.

Another beneficial feature of the portable cooler of the present invention is a means for selectively removing the cooling means 16 from inside the cabinet 4. It is desirable to be able to remove re-chillable cold packs from the portable cooler for placement in a household freezer or to remove thermoelectric cooling unit from the portable cooler for connection with a power source. The preferred means of selectively removing the cooling means from the cabinet preferably includes a combination of an access door 37 and temporary support ledge. The access door 37 must be sufficiently large enough to receive the cooling means. The access door is positioned in one of the walls 6 at a point convenient for retrieval and replacement of the cooling means 16. The support ledge 38 is used to temporarily support the cooling means 16 in the cabinet. The support ledge 38 protrudes inwardly from one of the walls and is positioned relative to the access door so that the cooling means may be easily inserted through the access door and placed atop the ledge. If a wedgeshaped cooling means is used according to the preferable arrangement wherein the longitudinal planar axis of the wedge is essentially horizontal, the ledge must be inclined to provide essentially horizontal placement of the longitudinal planar axis of the wedge.

The preferred cooler of the present invention includes a cabinet having a front wall 40, a rear wall, and a first 42 and second 44 side wall wherein the filling means 12 and the dispensing means 14 and the access doors 37 are located on the first and second side walls and a pair of ledges protrude inwardly from the front and back walls to support each cooling means. More preferably, as shown in FIG. 2, the portable cooler contains a plurality of wedge-shaped cooling means having their base sides 28 alternating positioned against the access doors 37 in the first and second side walls 42, 44, with the cooling means resting on a pair of ledges 38 protruding inwardly from the front and rear walls at an angle sufficient to allow an essentially horizontal placement of the longitudinal planar axis 24 of each wedge-shaped cooling means 16.

Figure 6:
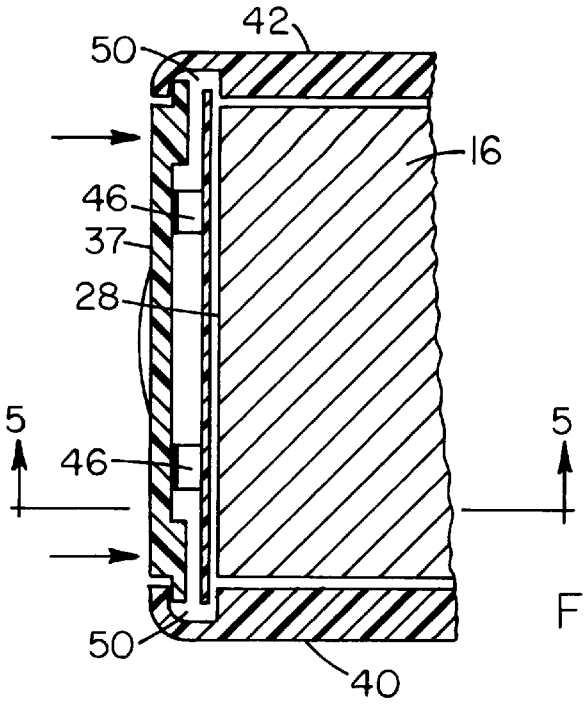
FIG. 6 is a top cross-section view of the cooler shown in FIG. 5.
Figure 5:
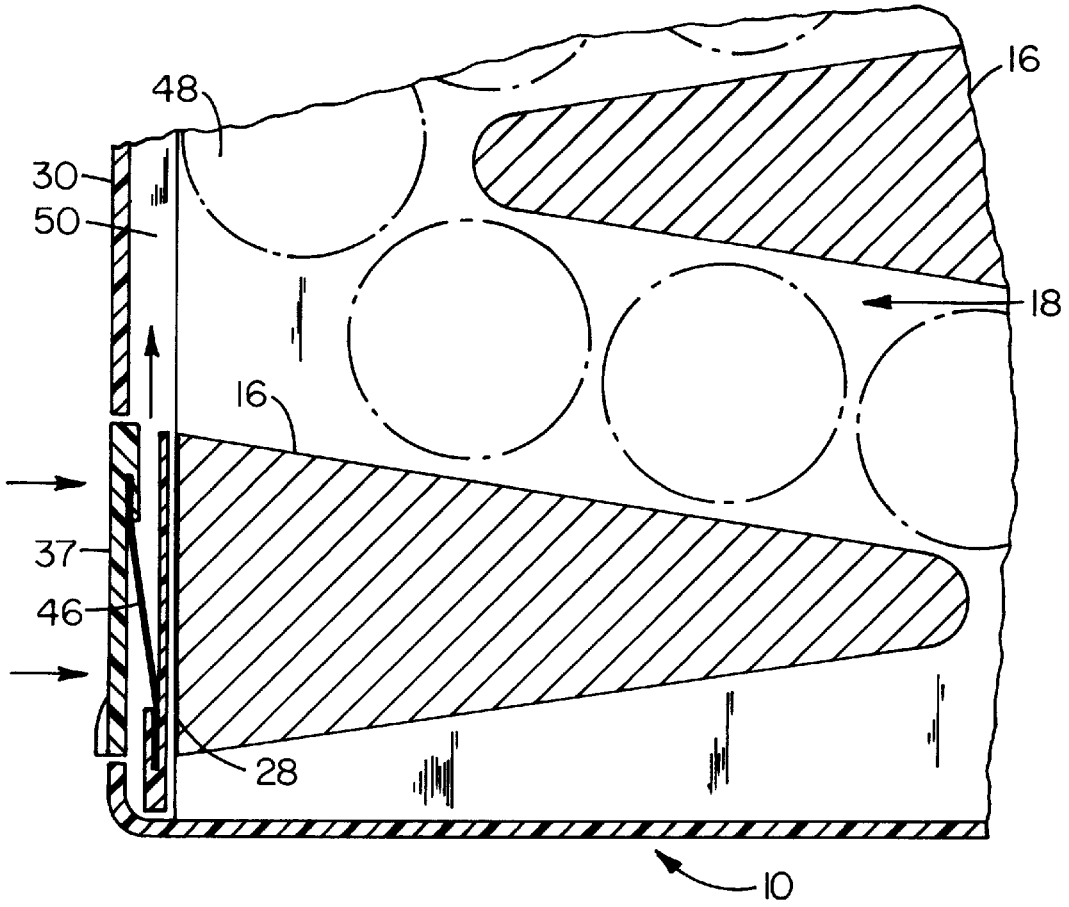
FIG. 5 is a side cross-section view illustrating the embodiment of the present cooler including a slideable access door with locking means.

A still further aspect of the present invention is that the access doors 37 are preferably substantially un-openable by way of engagement of the access door 37 with a locking means 46 located between each access door and it's corresponding cooling means 16, as shown in FIG. 5. The locking means 46 becomes engaged with the access door 37 when the cooling means 16 presses against the locking means due to the weight from items 48 stored in the channel above the cooling means. The locking means 46 can be any number of means, including a simple tension spring. A preferred embodiment, shown in FIG. 5, is an access door which is openable by slideable engagement in a grooved track 50 located just inside the wall. The locking means 46 presses against the access door 37 when engaged, thereby preventing the access door from easily becoming engaged with the grooved track. When unengaged, the preferred locking means is slideable in the grooved track in tandem with access door 37, as shown in FIG. 6. Such a locking means for the access door is beneficial in the present portable cooler to prevent the access doors from inadvertently opening and releasing the cooling means and stored items at an undesirable time.

The cabinet of the self-dispensing portable cooler of the present invention can be constructed of most any hard material. But it is preferable to use a material that is lightweight and insulative such as a lightweight plastic. The filling means and dispensing means may be any means providing access into the channel. An uncovered opening is included, but would be deleterious due to loss of chilled air and the influx of ambient air into the cabinet. Examples of useful closeable filling and opening means includes a variety of hinged doors, sliding doors, rotating doors, revolving doors, and gates. Since the dispensing means would typically be opened with much more frequency than the filling means, it is advantageous to use a revolving dispensing means constructed in a cup-like shape as shown in FIG. 2 so that one item is dispensed at a time without exposing the channel to an influx of ambient air.

The self-dispensing portable cooler of the present invention may additionally include an inner wall separating the inclined channel from another channel having a second filling means and a second dispensing means. The present invention is not limited by size. However, if portability is desired, the cooler must be reasonably small. Portability is promoted by the use of lightweight materials and by making maximum use of the space within the cabinet. Thus, the present employment of the cooling means to define the inclined channel in addition to providing the cooling function provides cooled storage and predictable dispensing of an increased number of items such as soda cans with the requirement of less space and less weight. Even further, the cooling effectiveness of the present cooler is significantly increased by the use of the wedge-shaped cooling means of the present invention.

Although the present invention has been described in terms of the presently preferred embodiments, it is to be understood that such disclosure is not to be interpreted as limiting to the invention described herein. No doubt that after reading the disclosure, various alterations and modifications will become apparent to those skilled in the art to which the invention pertains. It is intended that the appended claims be interpreted as covering all such alterations and modifications as fall within the spirit and scope of the invention.

What is claimed is:

1. A self-dispensing cooler comprising:

a) a cabinet defined by a plurality of opposing walls and a top and a bottom;

b) a filling means located near the top of one of said walls and defining a filling orifice for adding items to said cabinet;

c) a dispensing means positioned vertically distal from said filling means and defining a dispensing orifice on one of said walls; and d) a cooling means positioned at least partially inside said cabinet wherein said cooling means defines an unobstructed inclined channel therethrough connecting said filling orifice with said dispensing orifice.

2. The unit of claim 1 wherein said inclined channel has a size sufficient to force a plurality of said items into an essentially singular alignment, and allow an unobstructed movement of said items.

3. The unit of claim 2 wherein said plurality of items is a plurality of similarly sized cylindrical containers.

4. The unit of claim 1 wherein said channel is defined by a plurality of said cooling means, said channel having a serpentine shape defining a plurality of flights.

5. The unit of claim 4 wherein said channel includes about 2 to 5 flights, with each flight accommodating about 3 to about 8 items.

6. The unit of claim 1 wherein said cooling means includes a non-thermoelectric device.

7. The unit of claim 6 wherein said non-thermoelectric device is a container filled with a chillable liquid.

8. The unit of claim 1 wherein said cooling means includes a thermoelectric cooling device.

9. The unit of claim 1 wherein said dispensing means is a door constructed and arranged to dispense one of said units from said cabinet without exposing said channel to an influx of ambient air.

10. The unit of claim 1 further comprising an inner wall separating said channel from another channel having a second filling means and a second dispensing means.

11. The unit of claim 1 wherein said unit is portable.

12. A self-dispensing cooler comprising:

a) a cabinet defined by a plurality of opposing walls and a top and a bottom;

b) a filling means for adding items to said cabinet located near the top of one of said walls;

c) a dispensing means positioned vertically distal from said filling means on one of said walls; and d) a cooling means positioned at least partially inside said cabinet wherein said cooling means defines an inclined channel connecting said filling means to said dispensing means, wherein each of said cooling means has a wedge shape having a longitudinal planar axis, a base side positioned transverse to said axis and an opposing angle transected by said axis, wherein each of said cooling means is positioned inside said cabinet so that said longitudinal planar axis is substantially horizontal and said base side is vertically positioned against one of said walls.

13. The unit of claim 12 wherein a plurality of said wedge shaped cooling means are positioned alternatingly against opposing walls so that said channel has a serpentine shape defining a plurality of flights.

14. The unit of claim 12 wherein said cooling means is a wedge shape container filled with a chillable material.

15. A self-dispensing cooler comprising:

a) a cabinet defined by a plurality of opposing walls and a top and a bottom;

b) a filling means for adding items to said cabinet located near the top of one of said walls;

c) a dispensing means positioned vertically distal from said filling means on one of said walls;

d) a cooling means positioned at least partially inside said cabinet wherein said cooling means defines an inclined channel connecting said filling means to said dispensing means, and e) a means for selectively removing said cooling means from inside said cabinet.

16. The unit of claim 15 wherein said removing means includes an access door of sufficient size to receive said cooling means, said access door positioned in one of said walls at a point vertically between said filling means and said dispensing means; and a ledge sufficient to support said cooling means protruding inwardly from one of said walls, said ledge positioned relative to said access door such that said cooling means is selectively positionable atop said ledge while being inserted through said access door.

17. The unit of claim 16 wherein said plurality of opposing walls is a front wall, a back wall, and a first and second side wall, and said filling means, said dispensing means, and said door are positioned on said first and second side walls and a plurality of said ledges protrude from said front and back walls.

18. The unit of claim 16 wherein said door is intermittently non-openable by way of engagement of said door with a locking means, said locking means being engageable with said door under a sufficient force of weight against said locking means.

19. The unit of claim 18 wherein the weight of said items provides said force against said locking means.

* * * * *